US005421720A

United States Patent [19]

Sher

[11] Patent Number: 5,421,720

[45] Date of Patent: Jun. 6, 1995

[54] SAFETY LOCK LIGHTER WITH SLIDING MECHANISM

[75] Inventor: Tak C. Sher, North Point, Hong Kong

[73] Assignees: Polycity Industrial Ltd.; Tak Fi International (Holdings), both of Quarry Bay, Hong Kong

[21] Appl. No.: 225,391

[22] Filed: Apr. 8, 1994

[51] Int. Cl.[6] ..... F23Q 1/02

[52] U.S. Cl. ..... 431/153; 431/277

[58] Field of Search ..... 431/153, 276, 277

[56] References Cited

U.S. PATENT DOCUMENTS

| | | | |
|---|---|---|---|
| 5,074,781 | 12/1991 | Fujita | 431/277 X |
| 5,092,764 | 3/1992 | McDonough et al. | 431/277 |
| 5,165,885 | 11/1992 | Iwahori | 431/153 |
| 5,184,948 | 2/1993 | Iwahori | 431/276 |
| 5,186,618 | 2/1993 | Shike | 431/276 |
| 5,197,870 | 3/1993 | Yang | 431/153 |
| 5,213,493 | 5/1993 | Iwahori | 431/153 |
| 5,213,495 | 5/1993 | Pan | 431/344 |
| 5,215,458 | 6/1993 | Cirami | 431/277 |
| 5,224,854 | 6/1993 | Ansquer | 431/277 X |
| 5,271,731 | 12/1993 | Hsin-Chung | 431/254 |

FOREIGN PATENT DOCUMENTS

| | | | |
|---|---|---|---|
| 0296281 | 12/1988 | European Pat. Off. | 431/153 |

*Primary Examiner*—Carroll B. Dority

*Attorney, Agent, or Firm*—Ladas & Parry

[57] ABSTRACT

A safety lighter is disclosed. The lighter comprises a lighter body, a nozzle, a mounting frame disposed on the lighter body, and an actuating lever which is pivotally mounted on the mounting frame. The front end of the lever grips the nozzle and moves it from its lower position, where gas cannot escape from said nozzle, to the nozzle's upper position where gas is ejected from said nozzle when the rear end of the lever is depressed. The rear end of the lever has a downwardly extending leg. A sliding member is reciprocatingly mounted on the lighter body between a first position in which the rear end of the lever cannot be depressed because the leg contacts the sliding member and a second position in which a hole in the sliding member is located below the leg so that the rear end of the lever may be depressed.

4 Claims, 5 Drawing Sheets

SAFETY LOCK LIGHTER WITH SLIDING MECHANISM

BACKGROUND OF THE INVENTION

This invention relates to the field of lighters, such as cigarette lighters.

Modern butane lighters have become very popular. One of the reasons for their popularity is that the height of the flame produced by the lighter can be varied over a wide range by varying the amount of fuel allowed to be ejected from the lighter. The very feature which makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Also modern butane lighters suffer from the potential that the lever which actuates the lighter's nozzle will accidentally be depressed, thereby causing an unintended ejection of fuel, and therefore loss of fuel stored within the lighter body.

The invention disclosed herein significantly reduces the risk that the foregoing problems will be incurred by the provision of a safety lock feature which prevents the lighter's nozzle from begin put into the actuated position unless the user deliberately puts the lighter in an operational condition. In a preferred embodiment of the invention, the safety lock mechanism of the invention is automatically engaged.

SUMMARY OF THE INVENTION

Conventional lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker, flint, and flint spring combination, which igniter is positioned close to the rear end of the lever so that the igniter and the rear end of the lever may be actuated nearly simultaneously. When this occurs a flame is caused to be ignited from the head of the nozzle through which fuel is being ejected while the rear end of the lever is being held down.

In the invention disclosed herein, the rear end of the lever has a downwardly extending leg. A sliding member is reciprocatingly mounted on the lighter body between a first position in which the rear end of the lever cannot be depressed because the leg contacts the sliding member and a second position in which a hole in the sliding member is located below the leg so that the rear end of the lever may be depressed.

DETAILED DESCRIPTION OF THE INVENTION

Figure 1:
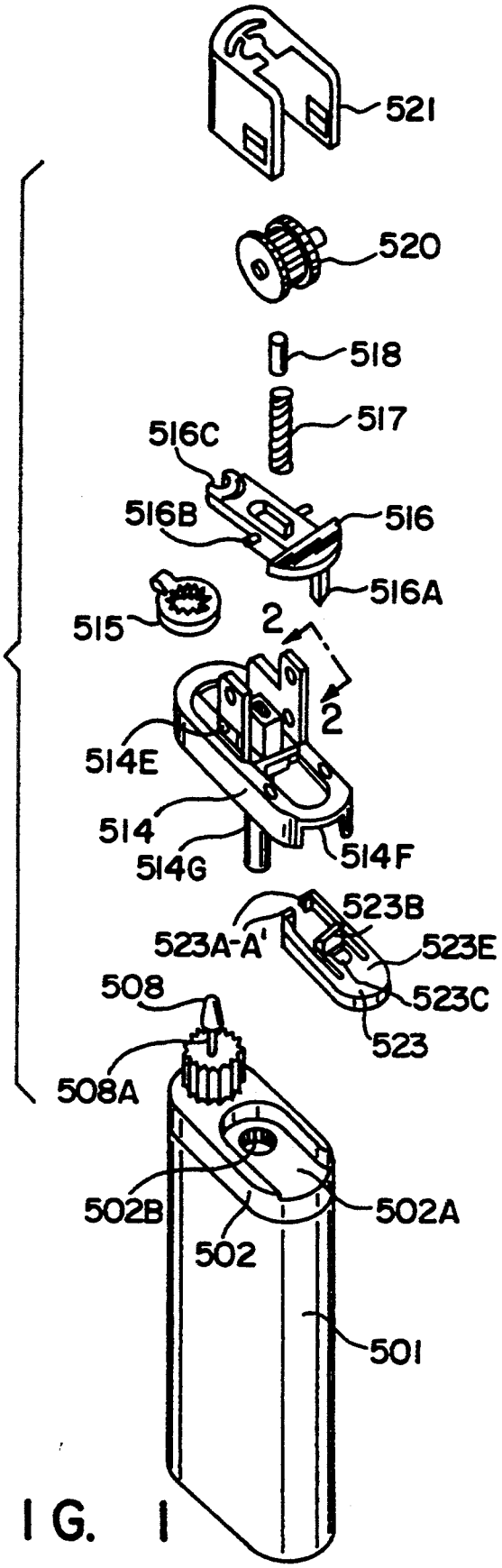
FIG. 1 is an exploded view of the safety lock lighter of the present invention.

The preferred embodiment of the subject invention is illustrated in the attached drawings which are referred to herein. The same reference numeral will be used to identify identical elements throughout the drawings.

FIG. 1 illustrates components commonly mounted on a lighter body 501 in which lighter fuel is contained. Such components include nozzle 508 having a head and downwardly extending tube 508A disposed toward the front of the lighter body, mounting frame 514, flame adjustment wheel 515, the igniter comprising flint spring 517, flint 518 and striker 520, nozzle actuating lever 516, and a windshield 521. Nozzle tube 508A is connected in communicating relationship with the interior of the lighter body where fuel is stored. When the nozzle is in its raised position, fuel can be ejected from it. When the nozzle is in its lower position, fuel cannot be ejected from it.

Figure 2:
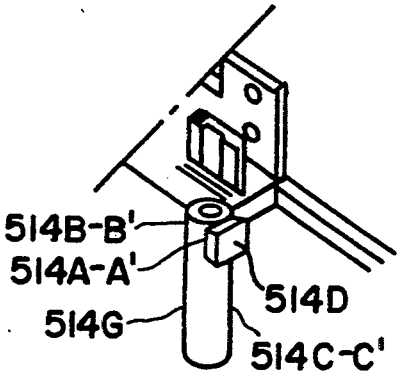
FIG. 2 is a magnified view of a portion of the lighter of the present invention, partially broken away, illustrating that portion of the invented safety lighter indicated by line 2—2 of FIG. 1.
Figure 3:
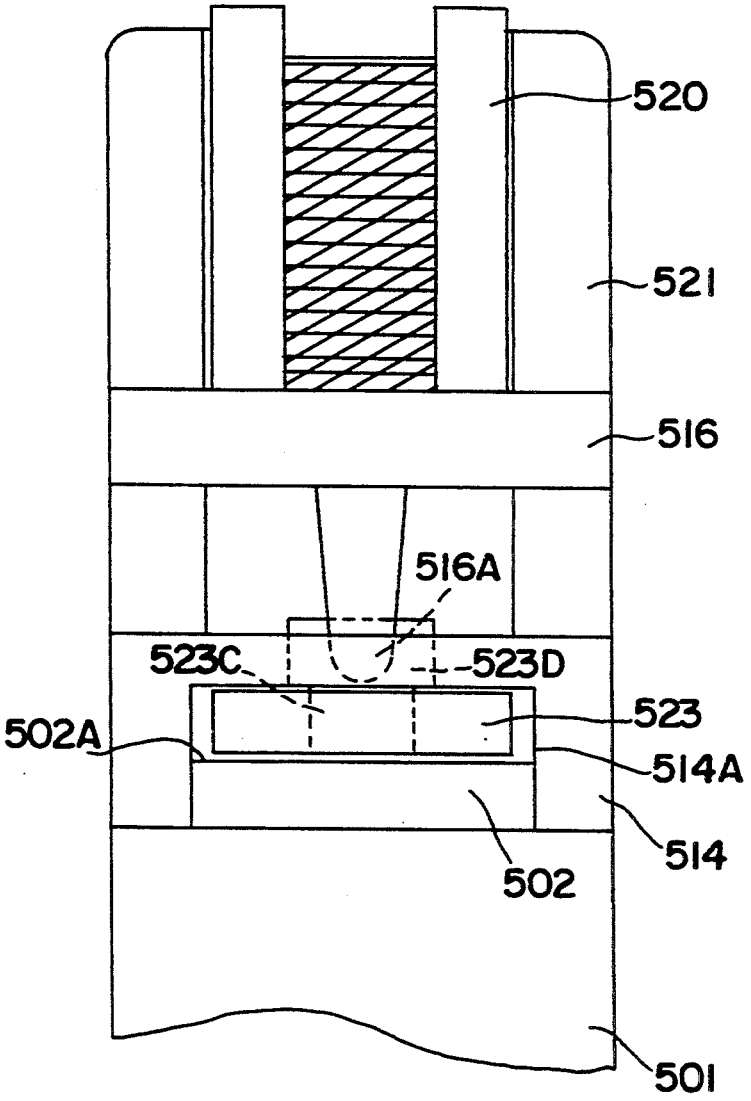
FIG. 3 is a partial rear cross sectional view of the present invention.

Illustrated in FIGS. 1–3 are elements forming a safety means of the present invention. These include recessed area 502A which is formed in the top surface 502 of the lighter body 501; opening 514F in the mounting frame 514 adjacent the rear of the lighter body; leg 516A of the nozzle actuating lever 516; cam 514G which extends vertically downward from the underside of the mounting frame 514, and slider 523.

The slider is fitted on top of the lighter body in the space defined by recess 502A, and the mounting frame 514 is disposed on top of the lighter body and the slider such that the posterior end 523D of the slider plate 523E extends through the opening 514F in the mounting frame 514 beyond the rear of the lighter body 501 as shown in FIG. 3. Slider 523 reciprocates back and forth between the safety locked position illustrated in FIGS. 4 and 5 and the lighter operational position illustrated in FIGS. 6 and 7.

The slider is moved from the safety position to the operational position by pulling the slider backward by hand. The slider is moved back to the safety position either by pushing the slider forward by hand or automatically upon the igniting of a flame as described further below.

Figure 7:
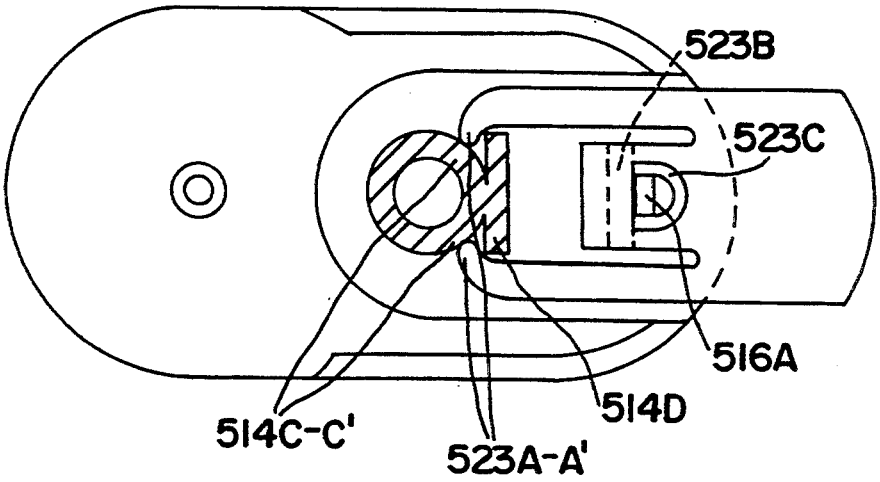
FIG. 7 is a partially sectional top view of the lighter of the present invention, with some parts removed, illustrating the lighter in its operational condition.

Excessive travel of the slider 523 in the forward direction is restricted by means of the upstanding protrusion 523B, extending upward from the anterior end of the slider plate, and the stopper 514B on the mounting frame illustrated in FIGS. 1, 2, 4 and 5. Excessive backward movement of the slider is prevented by resilient fingers 523A–A' which extend forward from the anterior of slider plate 523E. When the slider is pulled backwards the resilient fingers 523A–A' grasp onto the forward side of the stopper 514B, as shown in FIG. 7.

The slider is releasably maintained in the safety locked position by virtue of the relationship of the resilient fingers 523A–A' with cam 514G. As shown in FIGS. 1 and 2, cam 514G is a cylindrical projection which extends downwardly from the underside of the mounting frame 514. The bottom end of the cam fits within a cylindrical opening 502B formed in the upper part of the lighter body. When the slider is in the safety locked position, resilient fingers 523A–A' are located on the forward cam spots B–B'. When the user of the lighter desires to put the slider in the operational position, he pulls back on the rear end 523D of the slider plate with sufficient force to cause the resilient fingers 523A–A' to spread open as wide as the outside diameter of the cam 514G at point 514A–A' which is midway between 514B–B' and 514C–C'. As the user continues to pull the slider back, the resilient fingers close under the action of the elastic force inherent in the fingers and move toward the cam spots 514C–C' as shown in FIG. 7. At that point the resilient fingers 523A–A' also engage in the forward end of stopper 514D so that the slider cannot be pulled further back.

In going from the operational to the safety locked position, the user pushes the slider forward with sufficient force to cause the inwardly curved resilient fingers 523A–A' to again open up to the width of the diameter of the cam at 514A–A'. As the user continues to push the slider forward, the elastic force on the resilient fingers causes them to close until the resilient fingers reach cam spots 514B–B'. At that time further forward movement of the slider is prevented by virtue of the forward side of protrusion 523B coming into abutting relationship with stopper 514D on the mounting frame.

Slider 523 maybe made of a metallic material. However in the preferred embodiment slider 523 is made of a resilient plastic material.

As mentioned above, the cam is cylindrical and the resilient fingers 523A–A' are inwardly curved. To aid in the movement of the fingers over the contour of the cam, the resilient fingers are provided with a curve which approaches the contour of a circular arc. Other curved contours for the cam and the resilient fingers may also be used. In addition the cam, instead of being cylindrical, may be diamond shape in cross section.

Figure 4:
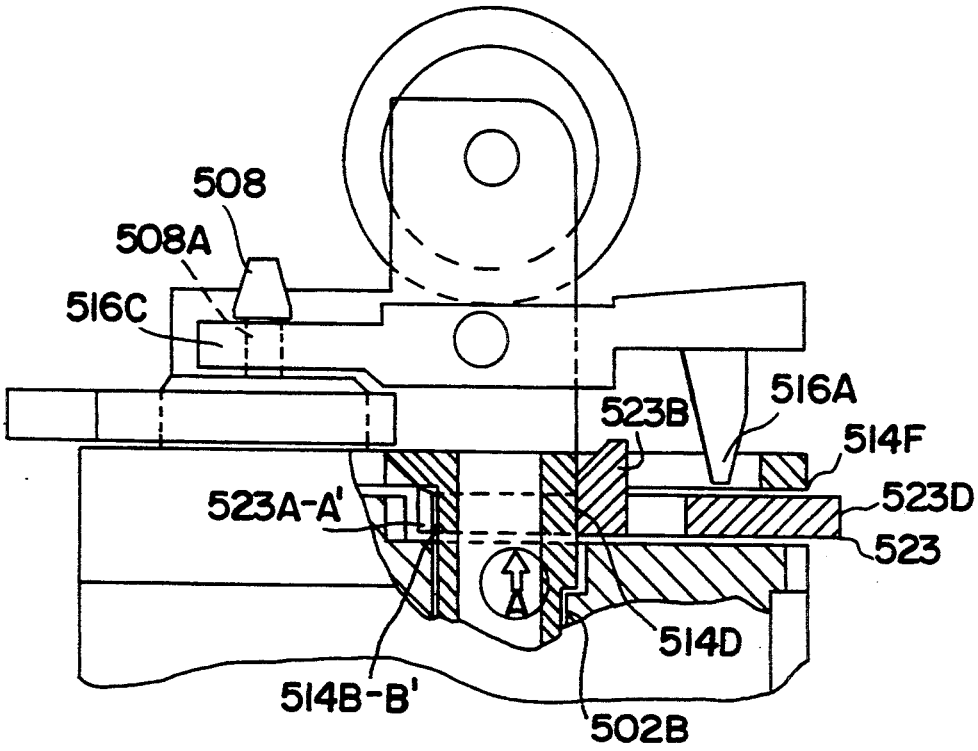
FIG. 4 is a partial side elevational view of the lighter of the present invention, partially broken away and sectioned, illustrating the lighter of the present invention in its safety locked condition, with the lighter's wind shield removed.

When the slider is in the safety locked position as shown in FIG. 4, leg 516A, which extends downward from the rear portion of the nozzle actuating lever 516, is positioned directly above the plate of slider 523. As a result, the downward movement of the rear end of the nozzle actuating lever is restricted and its front end cannot be moved up. Because the front end of the nozzle actuating lever cannot be pulled up, the nozzle itself remains in the lower position and fuel cannot be ejected from the lighter body.

Figure 6:
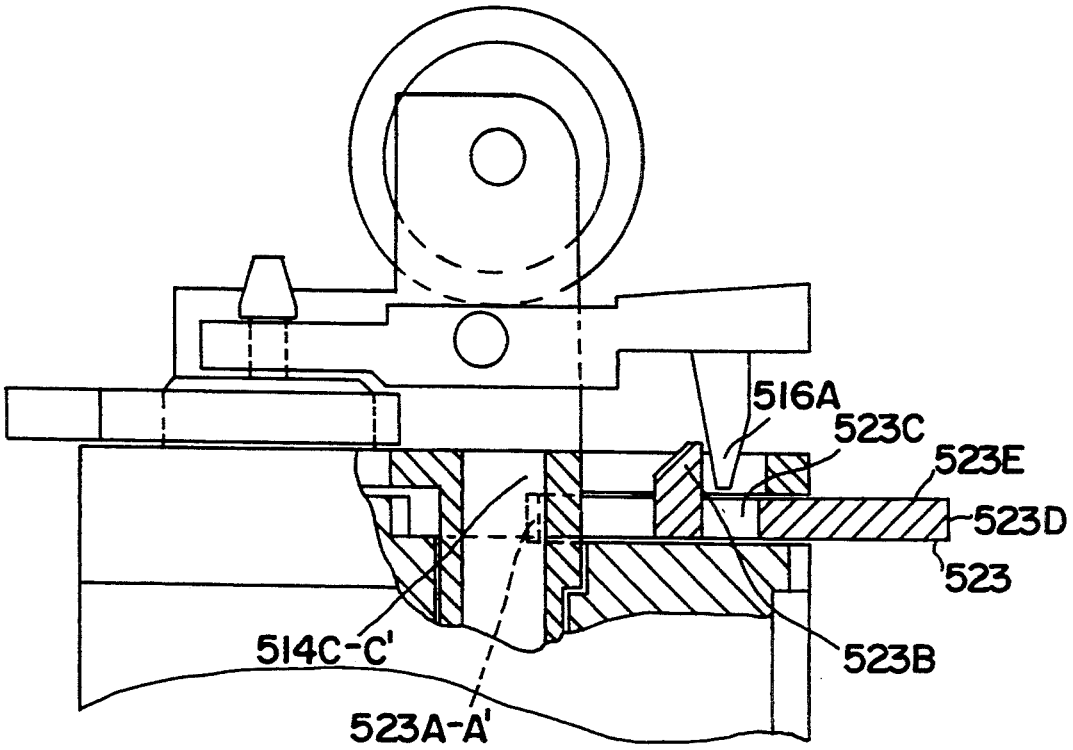
FIG. 6 is a partial side elevational view of the lighter of the present invention, partially broken away and sectioned, illustrating the lighter of the present invention in its operational condition, with the lighter's wind shield removed.
Figure 8:
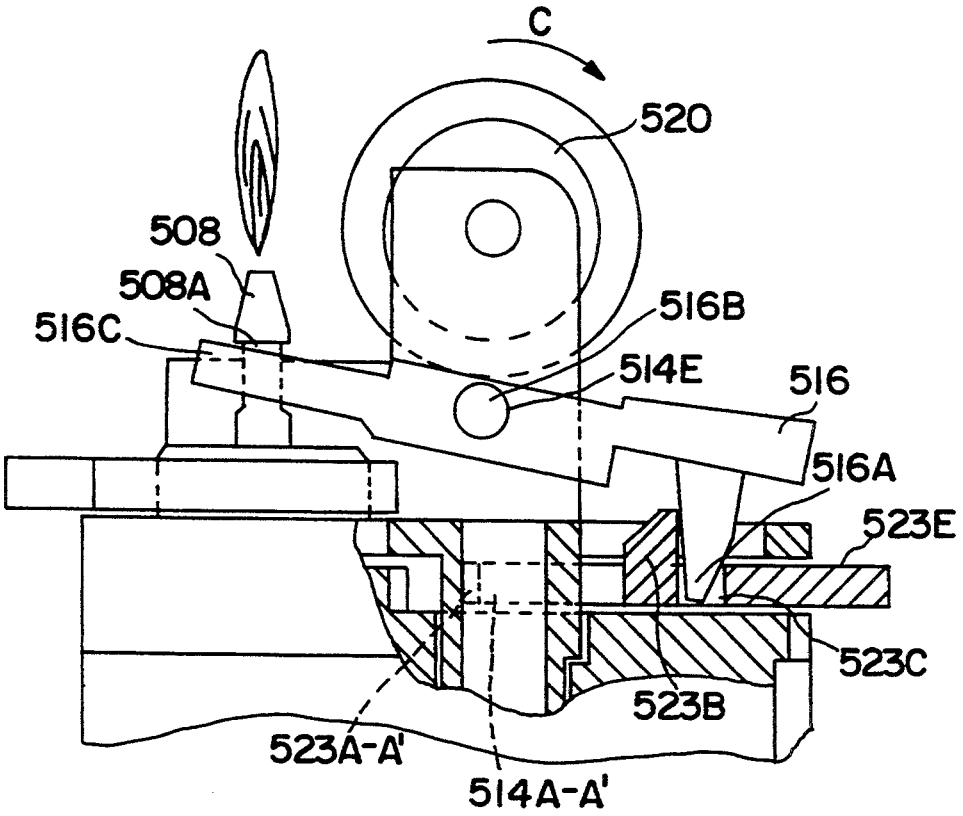
FIG. 8 is a partial side elevational view of the lighter of the present invention, partially broken away and sectioned, illustrating the lighter of the present invention in its operational condition and with its nozzle actuating lever in its actuated position, with the lighter's wind shield removed.
Figure 9:
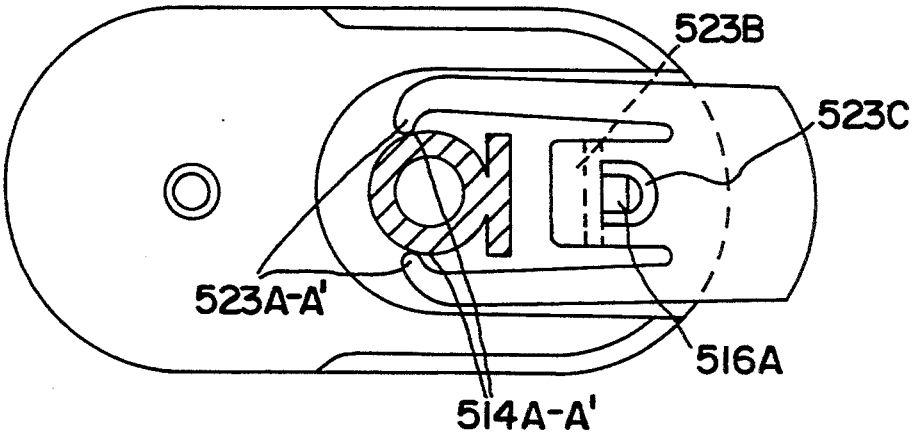
FIG. 9 is a partially sectional top view of the lighter of the present invention, with some parts removed, illustrating the lighter in its operational condition and with its nozzle actuating lever depressed.

FIG. 6 illustrates the lighter with the slider moved to the operational position. At this point, leg 516A is positioned directly above hole 523C formed in the plate 523E of slider 523 directly behind protrusion 523B. The opening 523C is dimensioned so as to be able to receive the entirety of the lower part of leg 516A. Because the leg 516A is positioned over hole 523C, the downward movement of the rear end of nozzle actuating lever 516 is not restricted. Thus it may be pushed downward and the nozzle actuating lever pivots about its pivoting axle or fulcrum 516B (see FIG. 8) which is mounted in fulcrum guide slot 514E of the mounting frame 514. As a result, the front end of the nozzle actuating lever rises upward as shown in FIG. 8. The front end of the nozzle actuating lever is provided with a gripper 516C, and the front end of the lever grips the nozzle 508 around its neck and under its head. Thus the in the operational condition illustrated in FIGS. 6, 7, 8, and 9, the lever is in a position to be able to raise nozzle 508 to eject gas when the rear end of the lever is pressed downward.

Striker wheel 520 is actuated by the user of the lighter to strike the flint 518 to generate a spark. The rear end of lever 516 is pressed downward by the user virtually simultaneously with the striker wheel being actuated while the nozzle 508 is raised upward by the front end gripper portion of the nozzle actuating lever, ejecting fuel to light a flame. The striker wheel 520 stops immediately after the lighting of a flame, while the ejection of gas and the flame are maintained during the period that the rear end of the lever is held down.

As the rear of the nozzle actuating lever is being pressed downward, the forward edge of leg 516A engages with the rear edge of protrusion 523B and urges it to move forward. As the rear end of the nozzle actuating lever is continued to be pushed downward, the protrusion 523B and with the rest of the slider 523 are urged forward to the position shown in FIGS. 8 and 9. At that point resilient finger's 523A–A' have passed just forward of cam spots 514A–A' of the cam 514G of the mounting frame 514. However, while the elastic force inherent in fingers 523A–A' would be enough to pull the slider forward until resilient fingers 523A–A' reach cam points 514B–B', further displacement in this direction is prevented while leg 516A remains within the hole 523C of the slider 523.

In a preferred embodiment the rear edge of the lower portion of leg 516A is angled inward as the rear edge approaches the bottom portion of leg 516A. This allows for the slider to move forward without hole 523C having to be very large.

Figure 5:
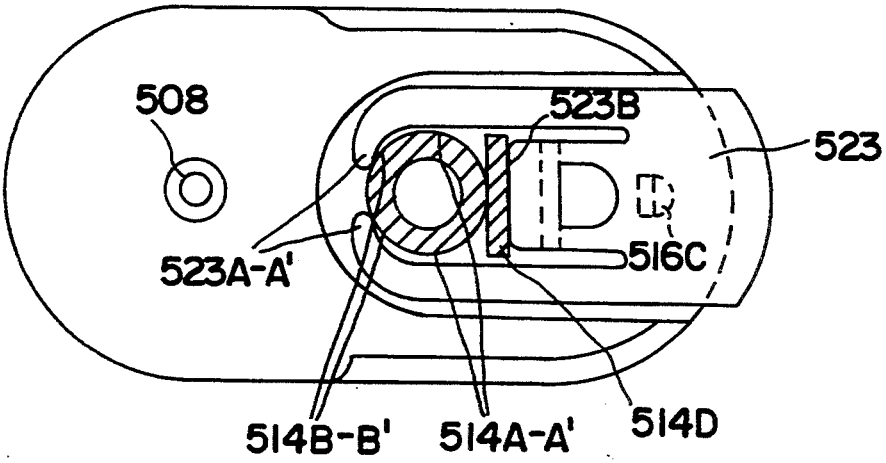
FIG. 5 is a partially sectional top view of the lighter of the present invention, with some parts removed, illustrating the lighter in its safety locked condition.

When the user's finger is removed from the rear end of nozzle actuating lever 516, leg 516A of lever 516 retreats from hole 523C as the rear end of the nozzle actuating lever rises, and the front end falls bringing down with it the nozzle. During this time, fingers 523A–A', under the effect of the elastic force inherent in them, close and cause the slider to be pulled forward until fingers 523A–A' reach cam spots 514B–B' at the front of cam 514G. Thus the slider is automatically returned to the safety locked position, preventing the accidental ejection of gas as shown in FIGS. 4 and 5. An auxiliary spring (not shown) may be used to enhance the movement of the slider toward a return to the safety locked position.

Above there has been described a unique safety lock lighter. It should be understood that various changes of the details, material, arrangements of parts and uses which have been herein described and illustrated in order to explain the nature of the invention will occur to and may be made by those skilled in the art upon the reading of this disclosure, and such changes are intended to be included within the principles and scope of this invention.

I claim:

1. A lighter comprising, a lighter body containing fuel in its interior, said lighter body having a front and a rear and a top surface extending from said front to said rear, said top surface having a recess formed therein which extends from the rear toward said front of said lighter body beyond a point midway between said front and rear, said recess having an opening formed therein and extending downward in the direction of the bottom of said lighter body;

a nozzle disposed in communicating relationship with the lighter body's interior and comprising a head extending above the lighter body, said nozzle reciprocatingly mounted upon said lighter body between a lower position and an upper position, said nozzle being configured so that fuel stored in said interior of said lighter body may be ejected from said nozzle head when said nozzle is in the upper position, and when said nozzle is in said lower position fuel cannot be ejected from said nozzle head;

a mounting frame disposed atop said lighter body, said mounting frame having a cam member extending into said opening;

a nozzle actuating lever having a front end and a rear end and a fulcrum disposed intermediate said front and rear ends, said lever having at its front end a gripper engaging said nozzle, said lever being pivotally mounted upon said mounting frame; said lever having a leg extending downward from the rear end of said lever;

a slider formed of a plate having an anterior end and a posterior end, a pair of resilient finger members extending forward from the anterior end of said plate, said plate having a hole formed therein behind said exterior end, said slider being reciprocatingly mounted in said recess in the top surface of said lighter body between first and second positions, wherein, when said slider is in said first position said fingers are in contact with a portion of said cam which is closer to the front of said lighter body than is the cam's middle, and said plate is positioned below said leg such that if said rear end of said lever is urged downward said leg comes is contact with said plate such that the downward movement of the rear end of said lever is prevented and the front end of said lever does not pivot upward to pull said nozzle into its upper position, and wherein, when said slider is in said second position said fingers are in contact with a portion of said cam which is closer to the rear of said lighter body than is the cam's middle, and said hole in said plate is positioned below said leg such that if said rear end of said lever is urged downward, said leg moves into said hole and does not come in contact with said plate and the rear end of the lever is allowed to move downward with the front end of said lever pivoting upward and pulling the nozzle from its lower position to its upper position.

2. The lighter of claim 1 wherein said slider further comprises a protrusion extending upward from the anterior end of said plate and said mounting frame further comprises a stop having a front side and a rear side, said stop being positioned rearward of said cam such that when said slider is in said first position said protrusion comes into abutting relationship with the rear side of said stop, and when said slider is in said second position said fingers come into abutting relationship with the front side of said stop.

3. The lighter of claim 1 wherein said leg has a front edge and a rear edge, and wherein said leg and said protrusion are configured such that when said slider is in said second position and the rear end of said lever is pressed downward, said front edge of said leg engages said protrusion and urges it forward so that said slider is moved toward said first position.

4. The lighter of claim 3 wherein the rear edge of said leg is tapers toward said front edge.

* * * * *